United States Patent [19]

Tong

[11] Patent Number: 4,751,424

[45] Date of Patent: Jun. 14, 1988

[54] IRON-NICKEL ALLOY SHADOW MASK FOR A COLOR CATHODE-RAY TUBE

[75] Inventor: Hua-Sou Tong, East Hemfield Twp., Lancaster County, Pa.

[73] Assignee: RCA Licensing Corporation, Princeton, N.J.

[21] Appl. No.: 129,369

[22] Filed: Nov. 30, 1987

Related U.S. Application Data

[63] Continuation-in-part of Ser. No. 19,858, Feb. 27, 1987, abandoned.

[51] Int. Cl.[4] ..... H01J 29/07

[52] U.S. Cl. ..... 313/402; 420/94

[58] Field of Search ..... 313/402; 445/47; 420/94; 148/12 R, 12.1

[56] References Cited

U.S. PATENT DOCUMENTS

| | | | |
|---|---|---|---|
| 2,643,949 | 6/1953 | Tisdale et al. | 75/133 |
| 3,087,234 | 4/1963 | Alexander et al. | 29/182.5 |
| 3,630,724 | 12/1971 | Hirayama et al. | 75/123 K |
| 3,657,026 | 4/1972 | Colling | 148/120 |
| 3,808,493 | 4/1974 | Kawamura et al. | 313/85 S |
| 4,082,580 | 4/1978 | Pfeifer et al. | 148/31.55 |
| 4,306,172 | 12/1981 | Matsukura et al. | 313/402 |
| 4,325,752 | 4/1982 | Suda et al. | 148/12.1 |
| 4,420,366 | 12/1983 | Oka et al. | 156/644 |
| 4,427,460 | 1/1984 | Araki et al. | 148/12 |
| 4,482,426 | 11/1984 | Maynard et al. | 156/640 |
| 4,536,226 | 8/1985 | Ohtake et al. | 148/12 C |
| 4,558,252 | 12/1985 | Kanto et al. | 313/402 |
| 4,596,943 | 6/1986 | Akiyoshi et al. | 313/402 |
| 4,631,439 | 12/1986 | D'Amato et al. | 313/402 |

FOREIGN PATENT DOCUMENTS

| | | | |
|---|---|---|---|
| 0209346 | 1/1987 | European Pat. Off. | 313/402 |
| 0025618 | 4/1973 | Japan | 420/94 |

OTHER PUBLICATIONS

High-Temperature Oxidation of Ni-20Cr Alloys with Dispersion of Various Reactive Metal Oxides, Japan Institute of Metals, vol. 22, No. 2 (1981), pp. 101 to 108, by Hiroshi Nagai and Makoto Okabayashi.

Discoloration-Free Invar Mask Color Picture Tubes, Toshiba Review, No. 156, Summer 1986, by Hidetoshi Yamazaki and Yasuhisa Ohtake.

*Primary Examiner*—David K. Moore

*Assistant Examiner*—Michael Horabik

*Attorney, Agent, or Firm*—Eugene M. Whitacre; Dennis H. Irlbeck; Vincent J. Coughlin, Jr.

[57] ABSTRACT

A shadow mask for a color cathode-ray tube has a plurality of apertures therethrough. The shadow mask is made from an improved iron-nickel alloy sheet consisting essentially of the following composition limits in weight percent: C≦0.04, MN≦0.1, Si≦0.04, P≦0.012, S≦0.012, Ni 32-39, Al≦0.08, Y≦0.6 and the balance being Fe and impurities unavoidably coming into the iron-nickel alloy during the course of the production thereof. An oxide layer comprising a major proportion of maghemite ($\gamma$-$Fe_2O_3$) and magnetite ($Fe_3O_4$), and a minor proportion of hematite ($\alpha$-$Fe_2O_3$) and yttria ($Y_2O_3$) is formed on the iron-nickel alloy sheet and stabilized and bonded thereto by an oxide of yttrium ($Y_2O_3$) dispersed at interstitial sites throughout the lattice of the alloy sheet.

5 Claims, 2 Drawing Sheets

Fig. 1
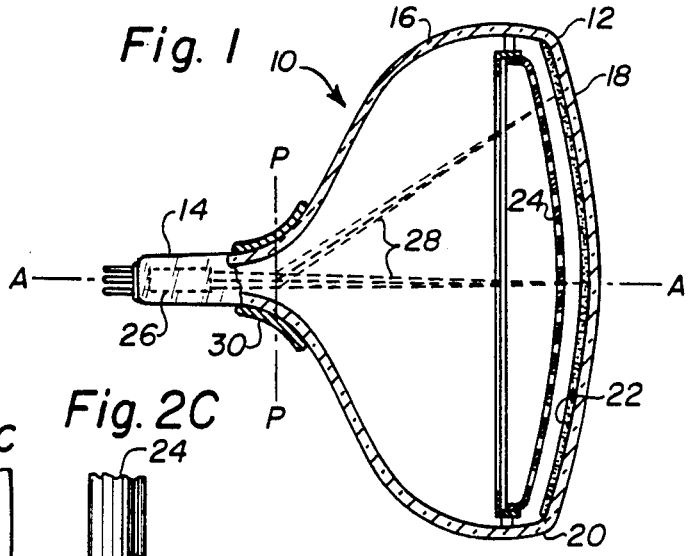
Fig. 2A
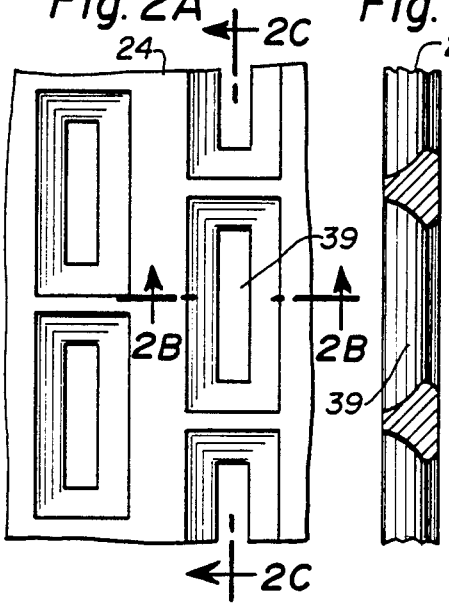
Fig. 2C
Fig. 2B
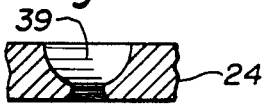
Fig. 3A
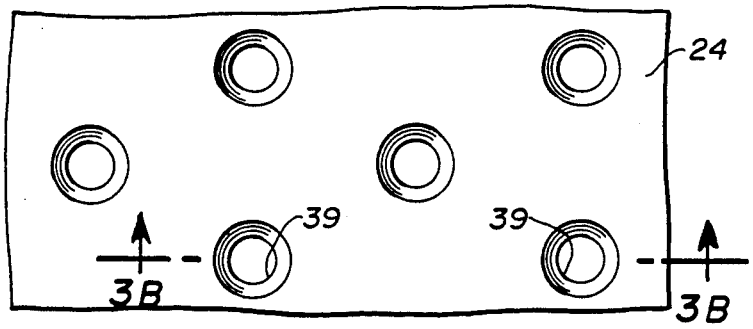
Fig. 3B
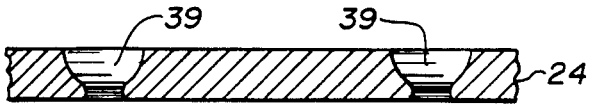

IRON-NICKEL ALLOY SHADOW MASK FOR A COLOR CATHODE-RAY TUBE

This is a continuation-in-part of application Ser. No. 019,858, filed Feb. 27, 1987, now abandoned.

BACKGROUND OF THE INVENTION

The invention relates to a shadow mask for a color cathode-ray tube and more particularly to a shadow mask made of an iron-nickel alloy which exhibits improved formability and oxidation characteristics.

A conventional shadow mask-type cathode-ray tube comprises generally an evacuated envelope having therein a screen comprising an array of phosphor elements of three different emission color which are arranged in cyclic order, means for producing three convergent electron beams which are directed toward the target and a color-selection structure including an apertured masking plate which is disposed between the target and the beam-producing means. The masking plate shadows the target and, therefore, is commonly called the shadow mask. The differences in convergence angles permit the transmitted portions of each beam to impinge upon and excite phosphor elements of the desired emission color. At about the center of the shadow mask, the masking plate intercepts all but about 18% of the beam currents; that is, the shadow mask is said to have a transmission of about 18%. Thus, the area of the apertures of the masking plate is about 18% of the area of the mask. The remaining portions of each beam which strike the masking plate are not transmitted and cause a localized heating of the shadow mask to a temperature of about 353 K. As a result, the shadow mask thermally expands causing a "doming" or expansion of the shadow mask toward the screen. When the doming phenomenon occurs, the color purity of the cathode-ray tube is degraded. The material conventionally used for the shadow mask, and which contains nearly 100% iron, such as aluminum-killed (AK) steel has a coefficient of thermal expansion of about $12\times10^{-6}$/K at 273 K. to 373 K. This material is easily vulnerable to the doming phenomenon.

Modern color television picture tubes are currently made in large sizes ranging from 25 to 27 inch diagonal dimensions and tubes as large as 35 inch diagonal are being produced in small quantities. Many of these tubes feature nearly flat faceplates which require nearly flat shadow masks of very low thermal expansivity.

Invar, an iron-nickel alloy, has low thermal expansivity, about $1\times10^{-6}$/K to $2\times10^{-6}$/K at temperatures within the range of 273 K. to 373 K.; however, conventional Invar has a high elasticity and a high tensile strength after annealing, as compared to ordinary iron. Additionally, it has proved to be difficult to produce a strongly adherent low reflection oxide coating, on a conventional Invar shadow mask. A dark oxide is desirable to enhance image contrast.

SUMMARY OF THE INVENTION

A shadow mask for a color cathode-ray tube has a plurality of apertures therethrough. The shadow mask is made from an improved iron-nickel alloy sheet consisting essentially of the following composition limits in weight percent: C≦0.04, Mn≦0.1, Si≦0.04, P≦0.012, S≦0.012, Ni 32–39, Al≦0.08, Y≦0.6 and the balance being Fe and impurities unavoidably coming into the iron-nickel alloy during the course of the production thereof. An oxide layer is formed on the iron-nickel alloy sheet and stabilized and bonded thereto by an oxide of yttrium dispersed at interstitial sites throughout the lattice of the alloy sheet.

BRIEF DESCRIPTION OF THE DRAWINGS

FIG. 1 is a plan view, partially in axial section, of a color cathode-ray tube embodying the present invention;

FIG. 2A is a plan view of a portion of a slit-type shadow mask;

FIG. 2B shows a section of the shadow mask shown in FIG. 2A taken along a line 2B—2B;

FIG. 2C shows a section of the shadow mask shown in FIG. 2A taken along a line 2C—2C;

FIG. 3A is a plan view of a portion of a shadow mask provided with circular apertures;

FIG. 3B is a section of the shadow mask shown in FIG. 3A taken along a line 3B—3B;

DETAILED DESCRIPTION OF THE PREFERRED EMBODIMENTS

Figure 4A:
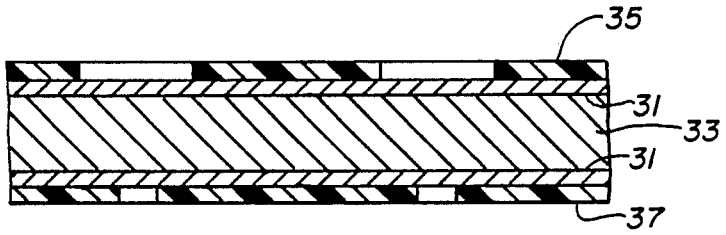
FIGS. 4A, 4B and 4C are sectional views showing the steps of manufacturing a shadow mask.

FIG. 1 is a plan view of a rectangular color cathode-ray tube 10 having a glass envelope comprising a rectangular faceplate panel or cap 12 and a tubular neck 14 connected by a rectangular funnel 16. The panel 12 comprises a viewing faceplate 18 and a peripheral flange or sidewall 20 which is sealed to the funnel 16. A mosaic three-color phosphor screen 22 is carried by the inner surface of the faceplate 18. The screen 22 is preferably a line screen with the phosphor lines extending substantially perpendicular to the high frequency raster line scan of the tube (normal to the plane of the FIG. 1). Alternately, the screen could be a dot screen as is known in the art. A multiapertured color selection electrode or shadow mask 24 is removably mounted, by conventional means, in predetermined spaced relation to the screen 22. The shadow mask 24 is preferably a slit mask as shown in FIGS. 2A, 2B and 2C or a circular aperture mask as shown in FIGS. 3A and 3B. An inline electron gun 26, shown schematically by dotted lines in FIG. 1, is centrally mounted within the neck 14 to generate and direct a trio of electron beams 28 along spaced coplanar convergent paths through the mask 24 to the screen 22.

The tube 10 is designed to be used with an external magnetic deflection yoke, such as the yoke 30 schematically shown surrounding the neck 14 and funnel 16 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. For simplicity, the actual curvature of the deflected beam paths in the deflection zone is not shown in FIG. 1.

The shadow mask 24 is made of an improved iron-nickel alloy sheet which exhibits improved formability and oxidation characteristics compared to conventional Invar. Invar is a trademark with registration number 63,970.

Table I compares the compositions, in weight percent (wt.%), of the improved alloy used in the present invention with a conventional Invar alloy.

TABLE I

| Composition Limits Of Shadow Mask Material (wt. %) | | | | | | | | | |
|---|---|---|---|---|---|---|---|---|---|
| | COMPOSITION | | | | | | | | |
| Type | C | Mn | Si | P | S | Al | Y | Ni | Fe |
| Improved Alloy | 0.04 | 0.1 | 0.04 | 0.012 | 0.012 | 0.08 | 0.6 | 32–39 | Bal |
| Conventional Invar* | 0.009 | 0.4 | 0.13 | 0.00 | 0.002 | — | — | 36.5 | Bal |

*Described in U.S. Pat. No. 4,536,226 issued to Ohtake et al. on August 20, 1985.

The improved alloy has lower concentrations of manganese and silicon than a conventional Invar alloy and contains a trace amount of aluminum. These compositional differences are believed to improve the etchability and formability of the resultant shadow mask 24. Additionally, a metallurgically sufficient quantity of yttrium is added to provide a fine dispersion of yttria (yttrium oxide, $Y_2O_3$) in the interstitial sites of the matrix or lattice of the improved alloy to stabilize and bond to the surfaces of the shadow mask 24 a subsequently formed oxide film described more fully hereinafter.

Etching tests were performed on a number of 4 inch×4 inch alloy samples and a control sample of aluminum killed (AK) steel. Table II compares the compositions of the (AK) control, a conventional Invar (INV.1), an improved alloy (V91) containing yttrium, and an improved alloy (V92) without yttrium.

TABLE II

| Composition Of Shadow Mask Material (wt. %) | | | | | | | | | |
|---|---|---|---|---|---|---|---|---|---|
| | COMPOSITION | | | | | | | | |
| Type | C | Mn | Si | P | S | Al | Y | Ni | Fe |
| AK | 0.002 | 0.30 | 0.01 | 0.016 | 0.009 | 0.052 | — | — | Bal |
| INV.1 | 0.009 | 0.48 | 0.23 | 0.001 | 0.002 | 0.018 | — | 34.3 | Bal |
| V91 | 0.023 | 0.10 | 0.003 | 0.004 | 0.005 | 0.079 | 0.59 | 36.21 | Bal |
| V92 | 0.029 | 0.09 | 0.030 | 0.007 | 0.002 | 0.068 | — | 36.35 | Bal |

Figure 4B:
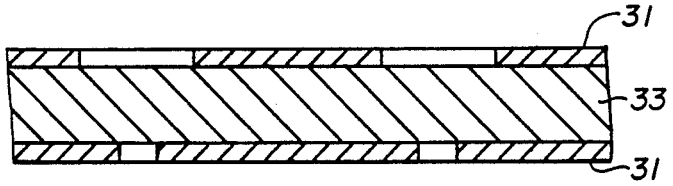

The etching tests were performed by applying suitable photosensitive films 31 onto the opposite surfaces of a shadow mask sheet 33 as shown in FIG. 4A. First and second plates 35 and 37, respectively, are disposed in contact with the shadow mask sheet coated with the photosensitive films 31. By exposing the plates 35 and 37 to light, the patterns thereon are respectively printed on both sides of the photosensitive films 31. Then, as shown in FIG. 4B, the portions of the films exposed to light are removed to partially expose the surfaces of the shadow mask sheet 33. The configuration and areas of the exposed surface correspond to the patterns on the plates 35 and 37.

Figure 4C:
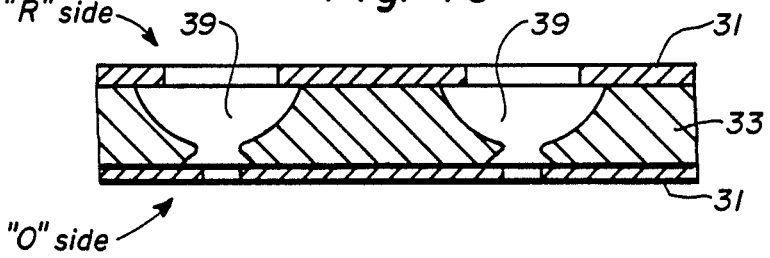

The exposed surfaces of the shadow mask sheet 33 are etched from both sides and after a certain period, apertures 39 (either slits or circular apertures) are formed through the sheet. Table III lists the etch parameters. The etch temperature was about 70° C. (157° F.) and the specific gravity of the etch solution was 47.2° Baume'. In FIG. 4C, the "O" side of the sample refers to the side of the shadow mask facing the electron gun and the "R" side refers to the side of the shadow mask facing the phosphor screen of the tube. All dimensions are in microns ($\mu$).

TABLE III

| Etch Factors Of AK Steel, Invar And Improved Alloys | | | | | |
|---|---|---|---|---|---|
| Sample | Width of Resist | Openings Plate | Under Cut | Etch Depth | Etch Factor |
| "O" Side | | | | | |
| AK | 3.9 | 5.37 | 0.735 | 1.96 | 2.67 |
| INV.1 | 3.9 | 5.47 | 0.785 | 2.12 | 2.68 |
| V91 | 3.9 | 5.86 | 0.980 | 2.25 | 2.30 |
| V92 | 3.9 | 5.63 | 0.852 | 1.84 | 2.11 |
| "R" Side | | | | | |
| AK | 17.33 | 19.20 | 0.935 | 2.58 | 2.76 |
| INV.1 | 17.33 | 19.64 | 1.155 | 3.07 | 2.65 |
| V91 | 17.33 | 19.58 | 1.125 | 2.81 | 2.49 |
| V92 | 17.33 | 19.47 | 1.070 | 2.59 | 2.42 |

In TABLE III undercut refers to the lateral amount of erosion of the shadow mask sheet under the photosensitive films 31. The etch factor is defined as the etch depth divided by the undercut. The improved alloy materials (V91 and V92), having lower concentrations of manganese and silicon than either conventional Invar (INV.1) or the aluminum killed (control) steel, show etch parameters comparable to conventional Invar and aluminum killed steel.

Additional tests were performed using six (6) sample heats of iron-nickel alloys. The compositions of the alloy samples are listed in TABLE IV and are substantially identical to each other except for the amount of yttrium.

TABLE IV

| Composition Of Iron-Nickel Alloy Shadow Mask Material (wt %) | | | | | | | | | |
|---|---|---|---|---|---|---|---|---|---|
| | COMPOSITION | | | | | | | | |
| Sample | C | Mn | Si | P | S | Al | Y | Ni | Fe |
| V61 | 0.001 | <0.01 | <0.01 | <0.005 | 0.003 | <0.005 | — | 34.82 | Bal |
| V62 | 0.001 | <0.01 | <0.01 | <0.005 | 0.002 | <0.005 | — | 35.90 | Bal |
| V63 | 0.001 | <0.01 | <0.01 | <0.005 | 0.001 | <0.005 | 0.10 | 34.87 | Bal |
| V64 | 0.001 | <0.01 | <0.01 | <0.005 | 0.001 | <0.005 | 0.11 | 35.78 | Bal |
| V65 | 0.001 | <0.01 | <0.01 | <0.005 | 0.001 | <0.005 | 0.18 | 34.64 | Bal |
| V66 | 0.001 | <0.01 | <0.01 | <0.005 | 0.001 | <0.005 | 0.17 | 35.70 | Bal |

Both the yttrium containing samples (V63 through V66) and the non-yttrium containing samples V61 and V62 were tested for formability by evaluating springback of 0.15 mm (0.006 inch) thick strip samples. Springback was measured for cold rolled samples and for samples annealed at 860° C. (1580° F.). The tests were performed by clamping one end of the strip and displacing the free end 90°. The strip was then released and the angular displacement was measured from the release point. In most instances three samples were measured and the results averaged. The results of the tests are summarized in TABLES V and VI.

TABLE V

| Iron-Nickel Cold Rolled Alloy | | |
|---|---|---|
| Sample | Springback° | Average |
| V61 | 87, 89, 88 | 88 |
| V62 | 88, 87, 87 | 87.5 |
| V63 | 88, 89.5, 89 | 89 |
| V64 | 89.5, 87, 88 | 88 |
| V65 | 89, 89, 87 | 88.5 |

TABLE V-continued

| Sample | Iron-Nickel Cold Rolled Alloy Springback° | Average |
|---|---|---|
| V66 | 88, 88.5, 88.5 | 88.5 |

TABLE VI

| Sample | Iron-Nickel Annealed 860° C. Alloy Springback | Average |
|---|---|---|
| V61 | 87, 85.5, —* | 86 |
| V62 | 88, 87.5, 87.5 | 87.5 |
| V63 | 88, 87, 85 | 86.5 |
| V64 | 86, 88, 88 | 87.5 |
| V65 | 87, 87, 89 | 87.5 |
| V66 | 87, 87.5, 87 | 87 |

*Only two annealed V61 samples tested.

The springback of the yttrium-containing samples (V63–V66) was comparable to that of the non-yttrium-containing samples (V61–V62). As expected, annealing generally decreased the springback of both the yttrium-containing and non-yttrium-containing samples.

Additional tests were run to determine the oxidation characteristics of the alloy samples and an aluminum killed control sample. All samples were steam blackened by exposing the material samples to steam at 600° C. to form an oxide layer. The oxide thickness is the peak oxide thickness and all samples had areas of no visible oxide. A desirable oxide thickness is about 1.5 micron. Oxide layers that are too thick tend to peel and generate particles, whereas very thin oxide layers degrade image contrast. The oxidation tests are summarized in TABLE VII.

TABLE VII

| Sample | Oxidation In Steam @ 600° C. Surface Roughness (Ra) (micron) | Oxide Thickness (micron) | Electro-polished* | Oxide Thickness (micron) |
|---|---|---|---|---|
| AK** | 0.5 | 5.50 | — | — |
| V61 | 0.5 | 1.64 | — | 0.47 |
| V62 | 0.5 | 1.76 | — | NV |
| V63 | 0.5 | 1.87 | — | 1.32 |
| V64 | 0.5 | 1.64 | — | 1.44 |
| V65 | 0.5 | 1.87 | — | 1.35 |
| V66 | 0.5 | 1.64 | — | 1.40 |

*Not measured for surface roughness.
**For AK steel, steam blackening using the above parameters produces an oxide that is too thick. Consequently, to obtain an oxide thickness of about 1.5μ either the temperature is reduced or a natural gas atmosphere is used.

The aluminum killed steel had a peak iron oxide thickness about three times greater than that of any of the iron-nickel alloy samples. The surface roughness (Ra) of each of the samples was about 0.5 microns. Additional alloy samples were electropolished to provide an essentially smooth (O micron) surface. The electropolished alloy samples were steam blackened at 600° C. and the peak oxide thicknesses were again measured. The yttrium-containing electropolished samples (V63–V66) had oxide thicknesses ranging from 1.32 micron to 1.44 micron which is considered satisfactory; whereas, the non-yttrium-containing electropolished sample V61 had a peak oxide thickness of only 0.47 micron and non-yttrium-containing electropolished sample V62 had no measurable oxide formed on the electropolished surface. The yttrium-containing electropolished alloy samples had a peak oxide thickness about three times greater than non-yttrium-containing electropolished alloy samples. The oxide layer formed on the yttrium containing alloy sample sheets comprises a major proportion of meghemite ($\gamma$-$Fe_2O_3$) and magnetite ($Fe_3O_4$), and a minor proportion of hematite ($\alpha$-$Fe_2O_3$) and yttria (yttrium oxide, $Y_2O_3$). In the yttrium-containing alloy samples (V63–V66) it is believed that the oxide layer is stabilized and bound to the surface of the samples by yttria (yttrium oxide, $Y_2O_3$) which is dispersed at interstitial sites throughout the lattice of the alloy sheet. Based on the results of the foregoing tests, a yttrium composition within the range of 0.1 to 0.2 wt. % is preferred.

What is claimed is:

1. A shadow mask having a plurality of apertures therethrough for use in a color cathode-ray tube, said shadow mask comprising an improved iron-nickel alloy sheet consisting essentially of the following composition limits in weight percent: C≦0.04, Mn≦0.1, Si≦0.04, P≦0.012, S≦0.012, Ni 32–39, Al≦0.08, Y≦0.6 and the balance being Fe and impurities unavoidably coming into said iron-nickel alloy during the course of production thereof, and an oxide layer formed on said iron-nickel alloy sheet, said oxide layer being stabilized and bound to said iron-nickel alloy sheet by an oxide of yttrium ($Y_2O_3$) dispersed at interstitial sites throughout the lattice of said alloy sheet.

2. The shadow mask as described in claim 1, wherein said oxide layer comprises maghemite ($\gamma$-$Fe_2O_3$), magnetite ($Fe_3O_4$), hematite ($\alpha$-$Fe_2O_3$) and yttria ($V_2O_3$).

3. A shadow mask having a plurality of apertures therethrough for use in a color cathode-ray tube, said shadow mask comprising an improved iron-nickel alloy sheet consisting essentially of the following composition limits in weight percent: C≦0.04, Mn≦0.1, Si≦0.04, P≦0.012, S≦0.012, Ni 34.5–37.5, Al≦0.08, Y≦0.5 and the balance being Fe and impurities unavoidably coming into said alloy during the course of production thereof, and an oxide layer formed on said alloy sheet, said oxide layer being stabilized and bound to said alloy sheet by $Y_2O_3$ dispersed at interstitial sites throughout the lattice said alloy sheet.

4. The shadow mask as described in claim 3, wherein said oxide layer comprises a major proportion of maghemite ($\gamma$-$Fe_2O_3$) and magnetite ($Fe_3O_4$), and a minor proportion of hematite ($\alpha$-$Fe_2O_3$) and yttria ($Y_2O_3$).

5. A shadow mask having a plurality of apertures therethrough for use in a color cathode-ray tube, said shadow mask comprising an improved iron-nickel alloy sheet consisting essentially of the following composition limits in weight percent: C≦0.04, Mn≦0.1, Si≦0.04, P≦0.012, S≦0.012, Ni 34.5–37.5, Al≦0.08, Y 0.1–0.2 and the balance being Fe and impurities coming into said alloy during the course of production thereof, and an oxide layer formed on said alloy sheet, said oxide layer comprising a major proportion of maghemite ($\gamma$-$Fe_2O_3$) and magnetite ($Fe_3O_4$), and a minor proportion of hematite ($\alpha$-$Fe_2O_3$) and yttria ($Y_2O_3$), said oxide layer being stabilized and bound to said alloy sheet by $Y_2O_3$ dispersed at interstitial sites throughout the lattice of said alloy sheet.

* * * * *

UNITED STATES PATENT AND TRADEMARK OFFICE

CERTIFICATE OF CORRECTION

PATENT NO. : 4,751,424

DATED : June 14, 1988

INVENTOR(S) : Hua-Sou Tong

It is certified that error appears in the above-identified patent and that said Letters Patent is hereby corrected as shown below:

Col. 6, line 32, "$(V_2O_3)$" should be --$(Y_2O_3)$--.

Column 6, line 45, after "lattice" add --of--.

Signed and Sealed this

Fifteenth Day of November, 1988

*Attest:*

*Attesting Officer*

DONALD J. QUIGG

*Commissioner of Patents and Trademarks*